US010156419B2

(12) United States Patent
Conant et al.

(10) Patent No.: US 10,156,419 B2
(45) Date of Patent: Dec. 18, 2018

(54) FIREARM

(71) Applicant: John Troy Conant, North Salt Lake, UT (US)

(72) Inventors: John Troy Conant, North Salt Lake, UT (US); Kyle Hill, Farmington, UT (US)

( * ) Notice: Subject to any disclaimer, the term of this patent is extended or adjusted under 35 U.S.C. 154(b) by 0 days.

(21) Appl. No.: 15/261,844

(22) Filed: Sep. 9, 2016

(65) Prior Publication Data

US 2017/0067715 A1 Mar. 9, 2017

Related U.S. Application Data

(60) Provisional application No. 62/216,064, filed on Sep. 9, 2015.

(51) Int. Cl.

| | |
|---|---|
| ***F41A 5/26*** | (2006.01) |
| ***F41C 7/02*** | (2006.01) |
| ***F41A 3/66*** | (2006.01) |
| ***F41A 21/48*** | (2006.01) |

(52) U.S. Cl.

CPC ..... *F41C 7/02* (2013.01); *F41A 3/66* (2013.01); *F41A 21/482* (2013.01)

(58) Field of Classification Search

CPC .... F41C 7/02; F41C 27/00; F41A 3/66; F41A 21/482; F41A 5/26; F41A 11/00

USPC ..... 42/18, 1.06, 75.01; 89/193, 14.05

See application file for complete search history.

(56) References Cited

U.S. PATENT DOCUMENTS

| | | | | |
|---|---|---|---|---|
| 5,661,255 | A * | 8/1997 | Webb, III | F41C 27/00 42/1.06 |
| 8,051,595 | B2 * | 11/2011 | Hochstrate | F41A 5/18 42/75.01 |
| 2011/0099869 | A1 * | 5/2011 | Bentley | F41A 9/65 42/6 |
| 2011/0277623 | A1 * | 11/2011 | Adolphsen | F41A 5/06 89/193 |
| 2013/0036902 | A1 * | 2/2013 | Adolphsen | F41A 5/26 89/193 |
| 2015/0330729 | A1 * | 11/2015 | Adolphsen | F41A 5/20 89/193 |

* cited by examiner

*Primary Examiner* — Michael D David
(74) *Attorney, Agent, or Firm* — Kunzler, PC

(57) ABSTRACT

A system and method are provided for a magazine-fed, pump-action firearm. The system comprises an extruded receiver having a longitudinal bore extending along the length of the extruded receiver, where the longitudinal bore forms a first opening in the extruded receiver for receiving a barrel, and a second opening in the extruded receiver for receiving a stock, a barrel extension key extending inward from an interior surface of the longitudinal bore, the barrel extension key configured to index and position the barrel, and a barrel nut configured to couple with the first opening of the extruded receiver and maintain the barrel substantially inside of the longitudinal bore between the barrel extension key and the barrel nut. The method includes extruding a receiver having a longitudinal bore, machining features on an exterior surface of the receiver, machining transverse openings in the receiver, and providing a barrel nut.

13 Claims, 13 Drawing Sheets

FIREARM

CROSS-REFERENCES TO RELATED APPLICATIONS

This application claims the benefit of and claims priority to U.S. Provisional Patent Application No. 62/216,064 entitled "FIREARM" and filed on Sep. 9, 2015 for Troy Conant et al., which is incorporated herein by reference.

FIELD

This invention relates to firearms and more particularly relates to pump-action, magazine-fed shotguns.

BACKGROUND

A shotgun is a firearm that is adapted to fire pellets or a solid slug. Shotguns come in a variety of sizes, and utilize a variety of operating mechanisms. Examples of operating mechanism include semi-automatic, lever-action, pump-action, single-barreled, double-barreled, etc. Shotguns are typically made of a barrel and a magazine tube connected to a receiver. The magazine tube feeds shotgun cartridges into the receiver, and a trigger group fires the shotgun cartridge which expels the pellets or slug through the barrel. The barrel and magazine tube can be removed from the receiver, along with all of the components that go along with the barrel and magazine tube. However, it may take some time to disassemble the barrel and magazine tube, along with the secondary components, from the receiver.

SUMMARY

An apparatus for a firearm having an extruded receiver is disclosed. A method of manufacturing the extruded receiver is also provided. In one embodiment, the apparatus includes an extruded receiver having a longitudinal bore extending along the length of the extruded receiver, where the longitudinal bore forms a first opening in the extruded receiver for receiving a barrel, and a second opening in the extruded receiver for receiving a stock, a barrel extension key extending inward from an interior surface of the longitudinal bore, the barrel extension key configured to index and position the barrel, and a barrel nut configured to couple with the first opening of the extruded receiver and maintain the barrel substantially inside of the longitudinal bore between the barrel extension key and the barrel nut.

In one embodiment, the barrel comprises a barrel nut stop extending outward from an outer surface of the barrel and configured to engage with the barrel nut. In another embodiment, a cartridge ejection opening is formed in a side of the extruded receiver, the cartridge ejection opening configured to allow fired cartridges to be ejected from a firing chamber of the extruded receiver.

The apparatus, in one embodiment, also includes a barrel extension disposed at one end of the barrel, and a notch that slideably engages the barrel extension key to rotationally index the barrel extension with the extruded receiver, which aligns a window of the barrel extension with the cartridge ejection opening. In another embodiment, the apparatus includes machined features formed in an exterior surface of the extruded receiver. For example, the machined features include a longitudinal groove or a plurality of transverse grooves. The plurality of transverse grooves forms a rail for receiving firearm accessories. In one embodiment, the longitudinal groove comprises a pair of longitudinal grooves disposed opposite each other on sides of the extruded receiver. The longitudinal grooves are configured to slideably engage slide members of a carriage assembly.

In one embodiment, the apparatus includes a bolt assembly coupled to the carriage assembly, where the bolt assembly comprises a locking lug, and a firing pin, and a grip assembly having a profile selected to slideably engage a bottom surface of the extruded receiver, and where the grip assembly is coupled to each of the pair of slide members. In a further embodiment, the apparatus includes a magazine well opening formed in the extruded receiver and configured to receive a magazine, where the magazine, when coupled, extends outward in a substantially perpendicular direction from the longitudinal bore.

In one embodiment, the apparatus includes a shelf formed adjacent the magazine well opening that is configured to engage and support a protrusion of a fire control group, such that the protrusion secures, together with a single pin fastener, the fire control group to the extruded receiver. In a further embodiment, the fire control group further comprises a pair of grooves configured to receive a pair of slide members of a carriage assembly.

The apparatus, in one embodiment, includes a fastener opening passing transversely through the extruded receiver adjacent the second opening. The fastener opening is configured to receive a fastener that couples a stock with the extruded receiver, where the stock has a portion that inserts into the second opening. In one embodiment, the apparatus includes a threaded portion positioned adjacent the first opening that is configured to engage threads of the barrel nut. In another embodiment, the barrel is configured with a length that, when inserted into the extruded receiver, does not extend outward past the barrel nut. In one embodiment, the barrel nut comprises a door breech.

A method of manufacturing an extruded receiver is also provided. In one embodiment, the method includes extruding a receiver having a longitudinal bore, machining features on an exterior surface of the receiver, machining transverse openings in the receiver, and providing a barrel nut.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION

The subject matter of the present application has been developed in response to the present state of the art, and in particular, in response to the problems and needs in the art that have not yet been fully solved by currently available firearm receivers. Accordingly, the subject matter of the present application has been developed to provide a firearm receiver that overcomes at least some shortcomings of the prior art.

Described herein are various embodiments of a firearm receiver that is formed of extruded aluminum. In particular, the described embodiments are useful for providing an improved shotgun assembly that utilizes a barrel nut that aligns and locks a barrel into the extruded aluminum receiver. As will be described below in greater detail, the barrel includes a barrel nut stop and a barrel extension, both of which are useful for aligning, indexing, and securing the barrel to the receiver.

Figure 1:
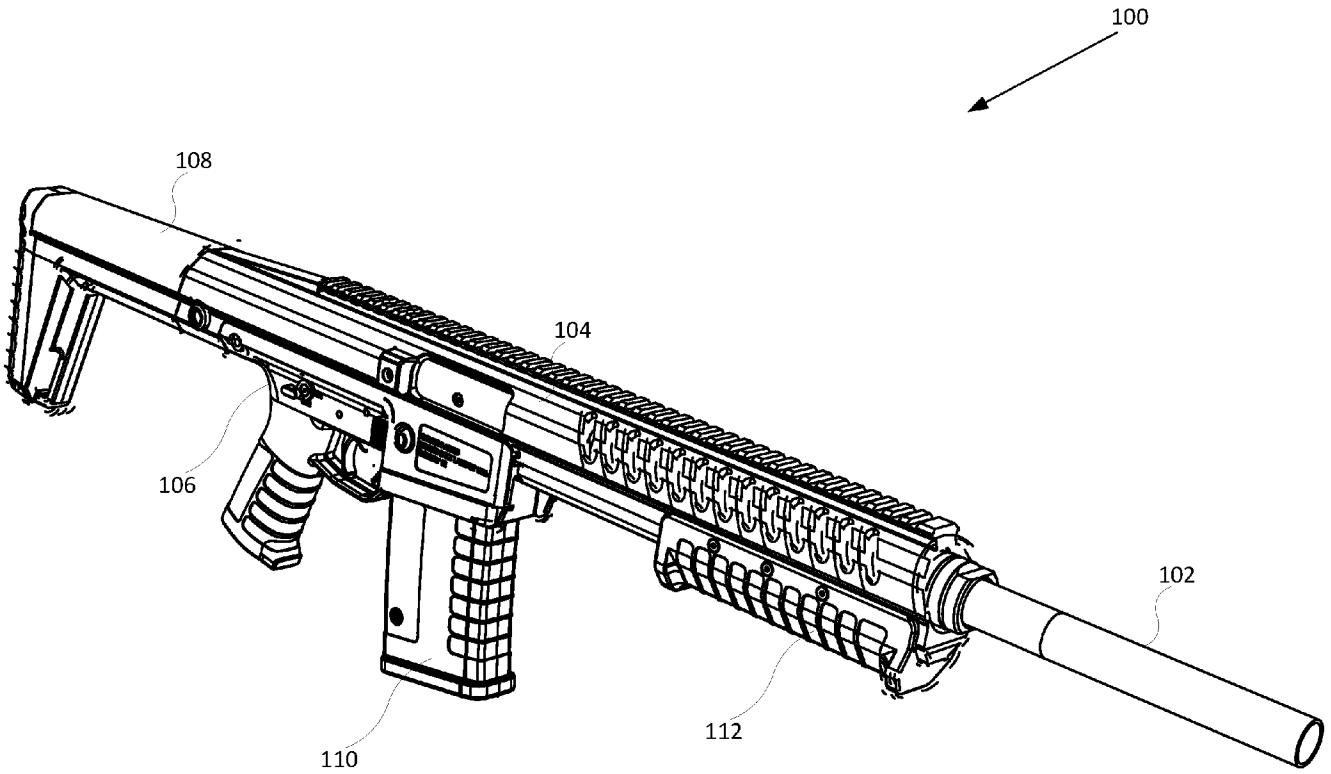
FIG. 1 is a perspective view diagram illustrating one embodiment of a firearm in accordance with embodiments of the present disclosure.

FIG. 1 is a perspective view diagram illustrating one embodiment of a firearm 100 in accordance with embodiments of the present disclosure. Although the below described embodiments describe a shotgun, the components and methods described may be modified to accommodate different types of ammunition. The shotgun 100, of the depicted embodiment, is generally formed with four main components: the barrel 102, the receiver 104, the fire control group 106, and the stock 108.

The receiver 104 is detachably secured with the fire control group 106 via a single pin that will be described below in greater detail with reference to FIG. 3. The shotgun 100 is considered to be a modular firearm that allows for easy replacement of worn or damaged components because the receiver 104 is detachable from the fire control group 106. Although throughout this specification the receiver 104 is simply referred to as "receiver," it should be noted that the described receiver 104 is mostly analogous to an "upper receiver" of an AR-style rifle that receives an AR-style barrel, and not a "lower-receiver" that houses the trigger group or trigger pack.

Unlike traditional shotguns, the depicted shotgun 100 is a magazine-fed, pump-action shotgun. Stated differently, the fire control group 106 is configured to receive a magazine 110. The magazine 110 maintains, in the depicted embodiment, shotgun shells that are cycled through the receiver 104 when the pump action 112 is actuated.

The receiver 104, in one embodiment, is formed of extruded aluminum. In other embodiments, the receiver 104 may be formed of other metals capable of being extruded, including, but not limited to, aluminum alloys, magnesium alloys, etc. By extruding the receiver 104, the amount of machining required to form the receiver 104 is significantly reduced.

As known to those skilled in the art, an extruder includes a hydraulic press which pushes a ram. The ram extends into a container that holds material to be extruded. A die is positioned in the container opposite the ram, and the ram pushes the material through the die to form the extrusion. The material may be cold or heated. In a cold extrusion, the material is placed in the container at room or ambient temperature. In a heat extrusion, the material is heated to a temperature that is greater than the recrystallization temperature of the material. Alternatively, the extruded receiver 104 may be formed by a warm extrusion process where the material is heated above room or ambient temperature, but below the recrystallization temperature of the material. Examples of a material suitable for use with embodiments of the present disclosure include, but are not limited to aluminum alloy. Other examples include other 7 series and 6 series aluminum alloys, and magnesium alloys.

Figure 2:
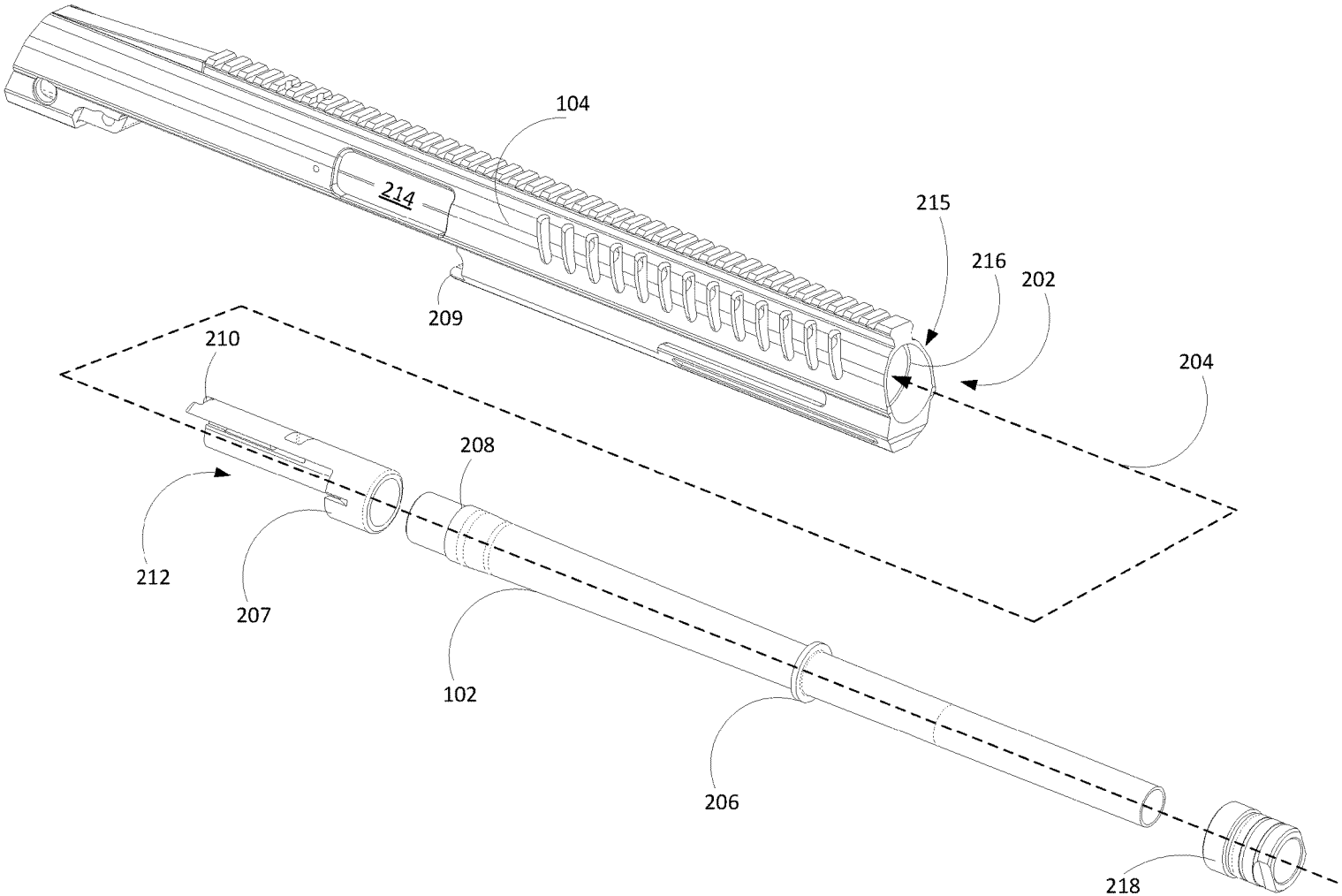
FIG. 2 is a perspective view diagram illustrating one embodiment of the receiver in accordance with embodiments of the present disclosure.

FIG. 2 is a perspective view diagram illustrating one embodiment of the receiver 104 in accordance with embodiments of the present disclosure. Resuming the discussion above with reference to FIG. 1, the extruded receiver 104 is formed with a bore 202, which extends parallel to a longitudinal axis, along the entire length of the receiver 104. In an alternative embodiment, the bore 202 may partially extend longitudinally through the extruded receiver 104. In other words, a partition may be positioned between two longitudinal bores to separate the section that houses the barrel from the section that houses the stock (see partition 315, FIG. 3).

Once the material is extruded, the material may be cut transversely to form a plurality of extrusion blocks (or "extrusions"). Beneficially, the extrusions may be cut at different lengths to form receivers capable of receiving different length barrels.

Each of the receivers 104 may be machined, following the extrusion process, to form features in the surface of the receiver 104. For example, such features may include, but are not limited to, grooves for improved grip, grooves for decoration, a Picatinny or Weaver rail for receiving accessories, grooves for receiving other components of the shotgun 100, openings for receiving fasteners, and openings for ejecting spent ammunition casing, etc.

The barrel 102, in one embodiment, is formed with a barrel nut stop 206. In one example, the barrel nut stop 206 is integrally formed with the barrel 102. Alternatively, the barrel nut stop 206 may be attached or fastened to the barrel 102. In other words, the barrel nut stop 206 may be welded or braised onto an exterior surface of the barrel 102. In a different embodiment, the barrel nut stop 206 is a removable lock washer or snap ring that engages a groove formed in the outer surface of the barrel 102. The barrel 102, in one embodiment, is formed of steel, or a steel alloy, and may be stainless steel or chrome-plated.

The barrel 102, as is known to those skilled in the art, is elongated and tubular and configured for directing ammunition from a first opening in the barrel 102 near the ammunition chamber to a second opening in the barrel 102 that generally extends outward past the end of the receiver 104. In alternative embodiments, the barrel does not extend past the barrel nut. The first opening of the barrel 102 is configured with a profile to engage a barrel extension 207. The barrel extension 207 is substantially tubular and has an opening for receiving the barrel 102. The barrel extension 207 is configured to slide over the barrel 102 and engage a shoulder 208 or step formed in the barrel 102.

The barrel extension 207 and the barrel 102 are configured to slide into the bore 202 of the receiver 104, as indicated by arrow 204. A notch 210 in the barrel extension 207 engages a barrel extension key (see FIG. 3) that is coupled with an interior surface of the bore 202 of the receiver 104. The notch 210 rotationally indexes the barrel extension 207 with reference to the receiver 104 so that a window 212 formed in the barrel extension 207 aligns with an opening 214 in the receiver 104.

Disposed adjacent the end 215 of the receiver are threads 216 for receiving a barrel nut 218. The barrel nut 218 slips over the barrel 102 and threads into the end 215 of the receiver 104. The barrel nut 218 functions to align the barrel and secure the barrel 102 inside the receiver 104. In this embodiment, the barrel nut 218 applies a compressive force on the barrel 102 between the barrel extension key and the barrel nut stop 206. The end result is that the barrel nut 218 aligns with and secures the barrel 102 in the receiver 104.

Figure 3:
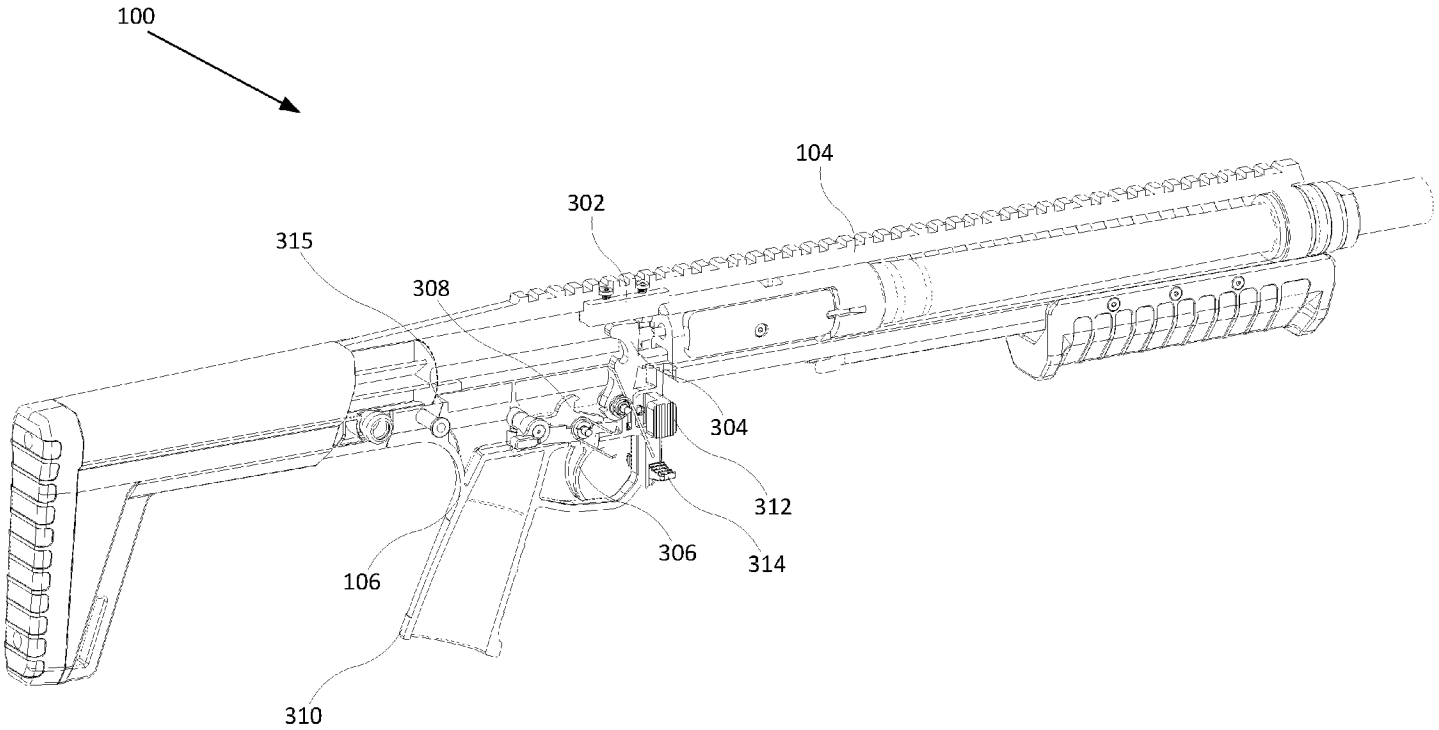
FIG. 3 is a partial cross-sectional view diagram illustrating one embodiment of the shotgun in accordance with embodiments of the present disclosure.

FIG. 3 is a partial cross-sectional view diagram illustrating one embodiment of the shotgun 100 in accordance with embodiments of the present disclosure. The depicted embodiment illustrates the above discussed barrel extension key 302. The barrel extension key 302, in one embodiment, is secured to an inner surface of the bore of the receiver 104. The barrel extension key 302 may be fastened with screws, as depicted, or alternatively permanently attached to the interior of the receiver 104. The barrel extension key 302 is positioned in the receiver 104 proximate to and above the trigger pack. In particular, the barrel extension key 302 is positioned above the hammer 304 when the hammer is in an un-cocked position (as depicted).

The trigger pack (i.e., trigger 306, disconnector 308, hammer 304, and various accompanying components) are housed within the fire control group 106. The fire control group 106 may also include a pistol-grip 310. Also housed within the fire control group 106 are the magazine release mechanism 312 and the carriage lock lever 314. The magazine release mechanism 312 is positioned adjacent a pivot point of the hammer 304 and is configured for releasing the magazine 110 from the fire control group 106 housing. As will become evident below, the magazine release mechanism 312 is capable of being actuated from either side of the shotgun 100.

The carriage lock lever 314, in one embodiment, is positioned adjacent the magazine release mechanism 312, and engages a carriage release mechanism that allows the carriage to move without discharging the shotgun 100. Accordingly, the shotgun 100 may be safely emptied of any ammunition by transitioning the carriage away from the fire control group 106 and removing any ammunition.

Figure 4:
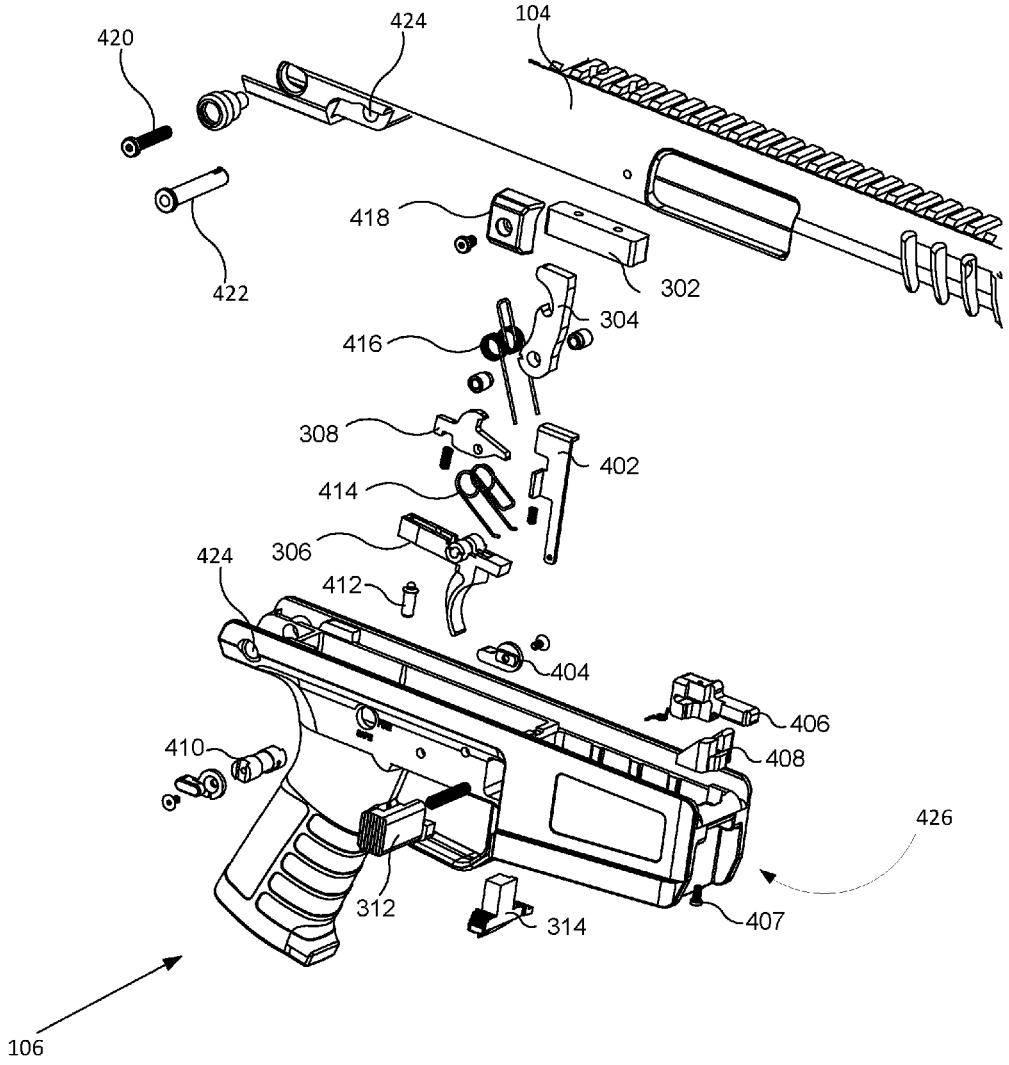
FIG. 4 is an exploded view diagram illustrating one embodiment of the fire control group in accordance with embodiments of the present disclosure.

FIG. 4 is an exploded view diagram illustrating one embodiment of the fire control group 106 in accordance with embodiments of the present disclosure. Illustrated in FIG. 4 are the barrel extension key 302, the hammer 304, a carriage release mechanism 402, a selector lever 404, a magazine release 406, a feed ramp 408, a selector shaft 410, a selector detent 412, a trigger spring 414, a hammer spring 418, and a shell deflector 418, and various fasteners. The assembly and operation of the parts illustrated will be understood by those having ordinary skill in the art.

One benefit of embodiments of the present disclosure is the feed ramp 408, which is removable. Traditionally, feed ramps are either integrally formed with the receiver, or formed as part of the carriage or bolt. Over time, as ammunition loads into the firing chamber via the feed ramp, the feed ramp becomes worn and eventually fails to properly load ammunition. The modular configuration of the shotgun 100 provides a feed ramp 408 that is easily removed and replaced. As shown, the feed ramp 408 slides into an opening in the fire control group 106, and may be fastened with a fastener 407.

Also depicted in FIG. 4 is a stock fastener 420. The stock fastener 420 couples the stock 108 (see FIG. 1) to the receiver 104. Accordingly, the owner of the shotgun 100 may beneficially replace damaged or worn stocks 108. Alternatively, the stock 108 may be replaced with a different stock that provides a different functionality or aesthetic. In one embodiment, the stock fastener is a pin 420 that passes through openings in the receiver 104 and the stock that are aligned with each other.

In one embodiment, the receiver 104 is coupled to the fire control group 106 with a single push pin 422 (i.e., fastener) at the rear (i.e., towards the stock 106) of the fire control group 106. The push pin 422 engages openings 424 in both the receiver 104 and the fire control group 106 to couple the fire control group 106 to the receiver 104. The fire control group 106 includes a protrusion 426 that extends forward (i.e., towards the firing end 215 of the receiver 104) and engages a shelf 209 (see FIG. 2) formed in the receiver 104. In operation, a user would first position the protrusion 426 on the shelf 209 of the receiver 104, and then pivot the fire control group 106 into position so that the openings 424 of the fire control group 106 align with the openings 424 of the receiver 104, at which point the push pin 422 is inserted to secure the fire control group 106 to the receiver 104.

Figure 5:
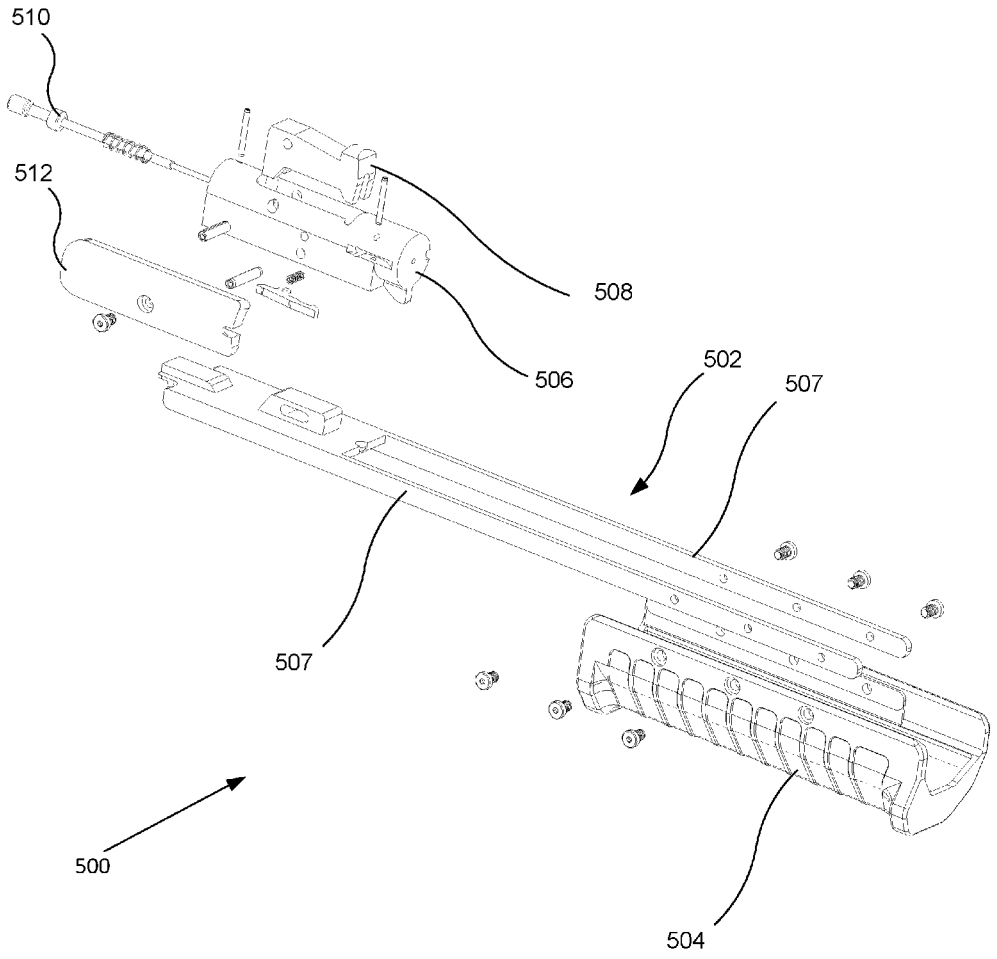
FIG. 5 is an exploded view diagram illustrating one embodiment of the carriage assembly in accordance with embodiments of the present disclosure.
Figure 9:
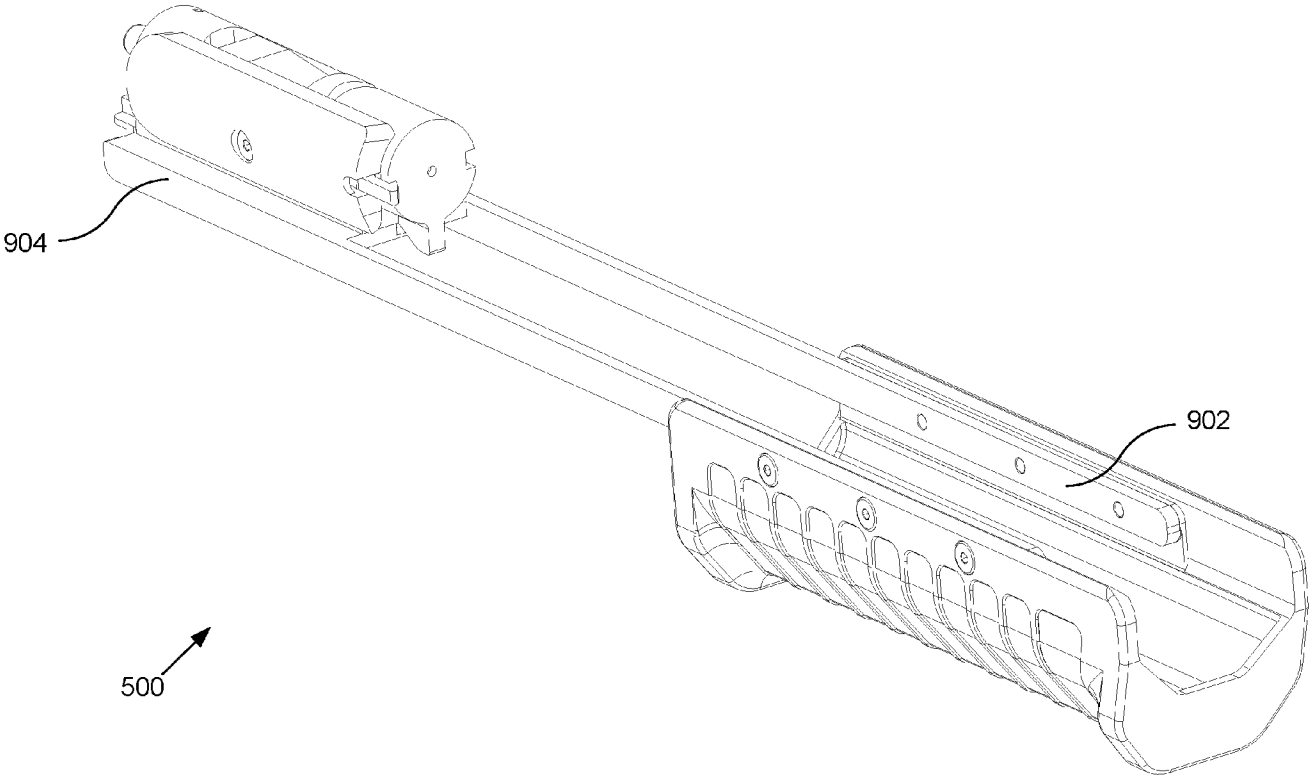
FIG. 9 is a perspective view diagram illustrating one embodiment of an assembled carriage assembly in accordance with embodiments of the present disclosure.

FIG. 5 is an exploded view diagram illustrating one embodiment of the carriage assembly in accordance with embodiments of the present disclosure. Beneficially, the carriage assembly (as depicted in FIG. 9) is removable as a single unit from the firearm 100. Accordingly, to clean or field strip the firearm 100, a user does not need to remove all of the individual pieces shown in FIG. 5, but instead can remove the entire assembly as a single piece.

The carriage assembly 500, or pump action, is configured to slide with reference to the fire control group 106 and the receiver 104. The carriage assembly 500 includes a bolt carriage 502 that may be formed having a generally elongated body. The bolt carriage includes a rearward portion to which a bolt 506 is mounted. Extending forward from the rearward portion is a pair of slide members 507. The slide members 507 are formed and configured to slide in corresponding grooves formed in the receiver 104. A pump grip 504 couples to both slide members and forms a hand grip that the shotgun 100 user may use to actuate the carriage assembly 500.

In one embodiment, a locking lug 508 is embeddable into an opening on a top surface of the carriage 506. The locking lug 508 is configured to lock the bolt in a closed position for firing. A firing pin 510 is slideably coupled with the bolt 508 and is actuated by the hammer 304 (see FIG. 3). The firing pin 510 extends through a bore in the bolt 506 that extends in a direction parallel to a longitudinal axis of the bolt 506.

The carriage assembly 500, in one embodiment, may also include a bolt shield 512. The bolt shield 512 is removably attached to the bolt 506. The assembly and operation of the parts illustrated will be understood by those having ordinary skill in the art.

Figure 6:
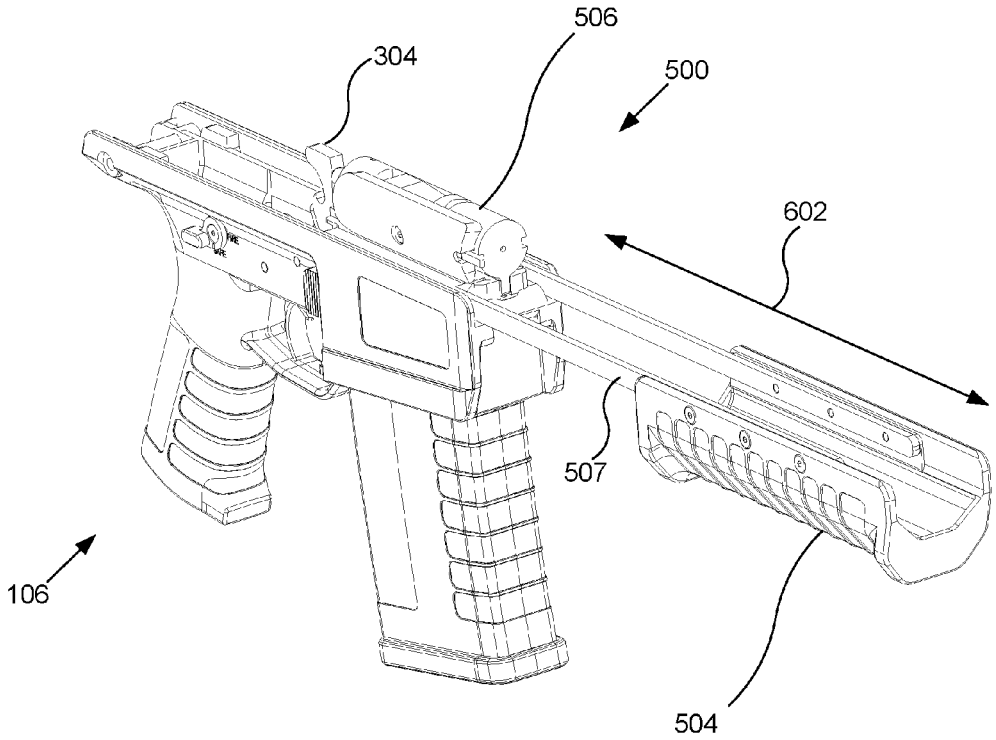
FIG. 6 is a perspective view diagram illustrating one embodiment of the fire control group and the carriage assembly in accordance with embodiments of the present disclosure.

FIG. 6 is a perspective view diagram illustrating one embodiment of the fire control group 106 and the carriage assembly 500 in accordance with embodiments of the present disclosure. In the depicted embodiment, the slide rails of the bolt carriage 502 engage grooves formed on the left and right halves of the fire control group 106. As described above, the carriage assembly 500 slides in grooves formed in both the fire control group and the receiver 104. The carriage assembly 500 moves in a direction indicated by arrow 602 with reference to the fire control group 106. When the carriage assembly 500 slides towards the fire control group 106, the bolt 506 engages the hammer 304 and causes the hammer 304 to pivot downwards until the hammer connects to the disconnector 308 (see FIG. 3). Upon moving the carriage assembly 500 forwards, the components of the fire control group 106 are now armed and ready to discharge ammunition that was loaded from the magazine into the chamber when the carriage assembly 500 moved forward.

In one embodiment, both ends of the carriage assembly 500 are maintained in grooves thereby securing the carriage assembly 500 to the shotgun 100. Beneficially, this enables a carriage assembly 500 that can be removed from the shotgun as a single unit for cleaning or maintenance. Advantageously, the shotgun 100 may be broken down quickly into 4 major components: the receiver 104 and barrel 102, the fire control group 106, the carriage assembly 500, and the stock 108.

Figure 7:
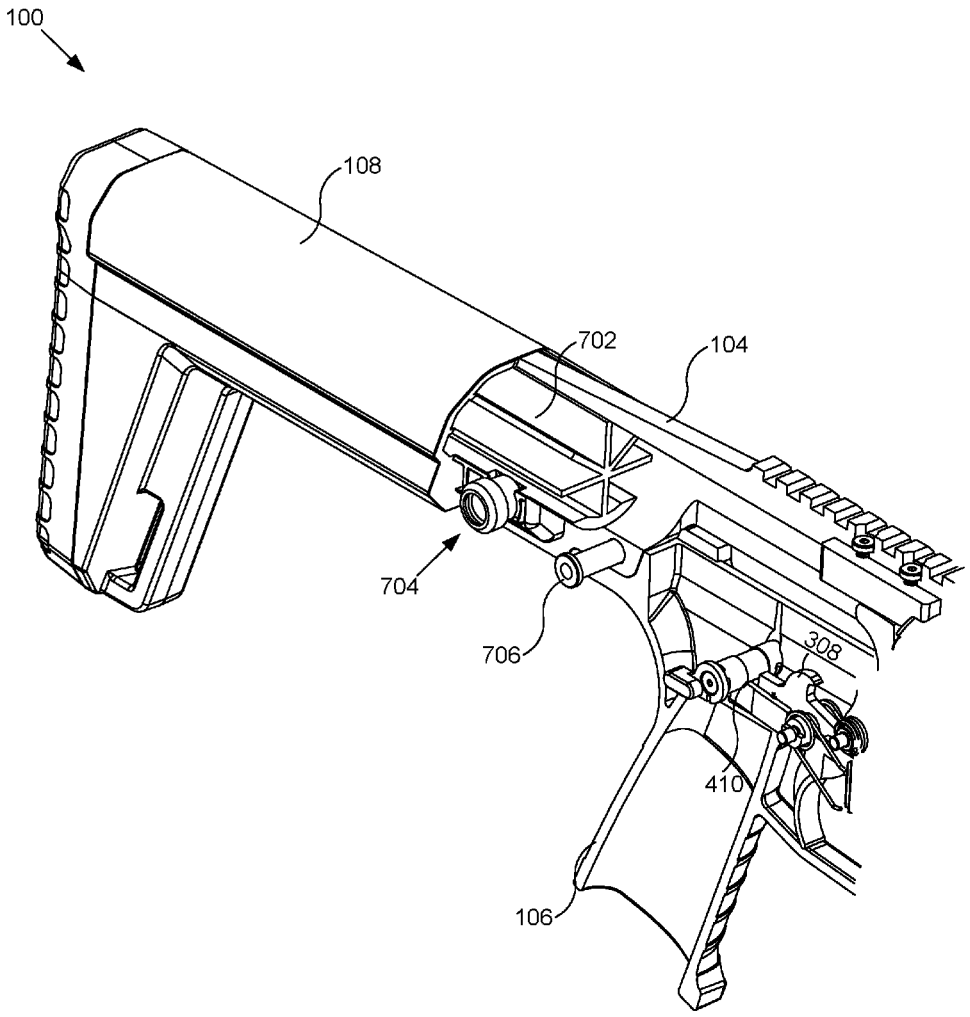
FIG. 7 is a partial cross-sectional view illustrating one embodiment of the firearm in accordance with embodiments of the disclosure.

FIG. 7 is a partial cross-sectional view illustrating one embodiment of the firearm in accordance with embodiments of the disclosure. The depicted embodiment illustrates one example of how the stock 108 couples to the receiver 104. As described above, the receiver 104 is extruded with a bore that extends lengthwise along the extrusion. One end of the bore is configured to receive the barrel; the other end of the bore is configured to couple with the stock 108. In one embodiment, the stock includes a portion 702 that extends into the bore of the receiver 104. The portion 702 may be a solid cylinder of material, or alternatively (and as depicted) a framework of material configured to securely mount the stock 108 to the receiver 104.

As previously described, a fastener passes through aligned openings 704 formed in both the stock 108 and the receiver 104 to couple the stock 108 to the receiver 104. Similarly, a fastener 706 couples the fire control group 106 to the receiver 104. The fastener 706, in one embodiment, comprises a press fit fastener that is removable without the use of tooling. Beneficially, this allows a user to break down the shotgun 100 by only removing a single fastener.

FIG. 7 also depicts how the selector shaft 410 engages the disconnector 308. Rotating the selector lever, which rotates the selector shaft 410, turns the selector shaft 410 to a position which immobilizes the disconnector 308 so that when a user pulls on the trigger, the disconnector 308 is not able to release the hammer.

Figure 8:
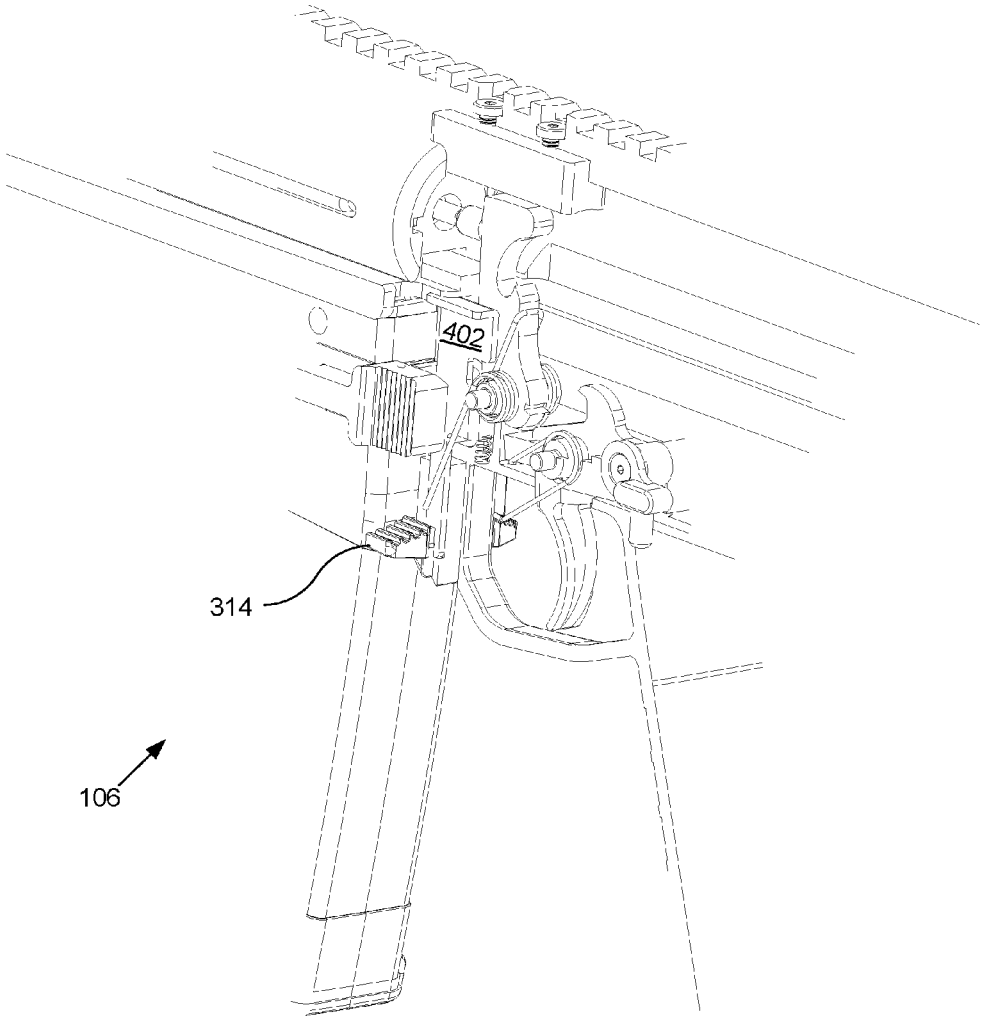
FIG. 8 is a perspective view diagram illustrating one embodiment of the internal components of the fire control group in accordance with embodiments of the present disclosure.

FIG. 8 is a perspective view diagram illustrating one embodiment of the internal components of the fire control group in accordance with embodiments of the present disclosure. The depicted embodiment illustrates the carriage release 402. The carriage release 402 extends upward from the carriage lock lever 314, which has ambidextrous controls (i.e., on both sides) on the outside of the fire control group 106 housing. A spring disposed between an inner surface of the fire control group 106 housing and the carriage release 402 biases the carriage release 402 upwards. Pulling downwards on the carriage release lever 314 releases the carriage assembly 500 and allows the carriage assembly 500 to move rearward (towards the stock) to allow the user to discharge ammunition without firing the shotgun 100.

FIG. 9 is a perspective view diagram illustrating one embodiment of an assembled carriage assembly 500 in accordance with embodiments of the present disclosure. The depicted carriage assembly 500 is another embodiment of the carriage assembly described above with reference to FIG. 5. As described above, the carriage assembly includes slide rails 902 that engage grooves formed in the receiver 104. The rear portion 904 of the carriage assembly 500 is configured to slide in grooves of the fire control group 106.

Figure 10:
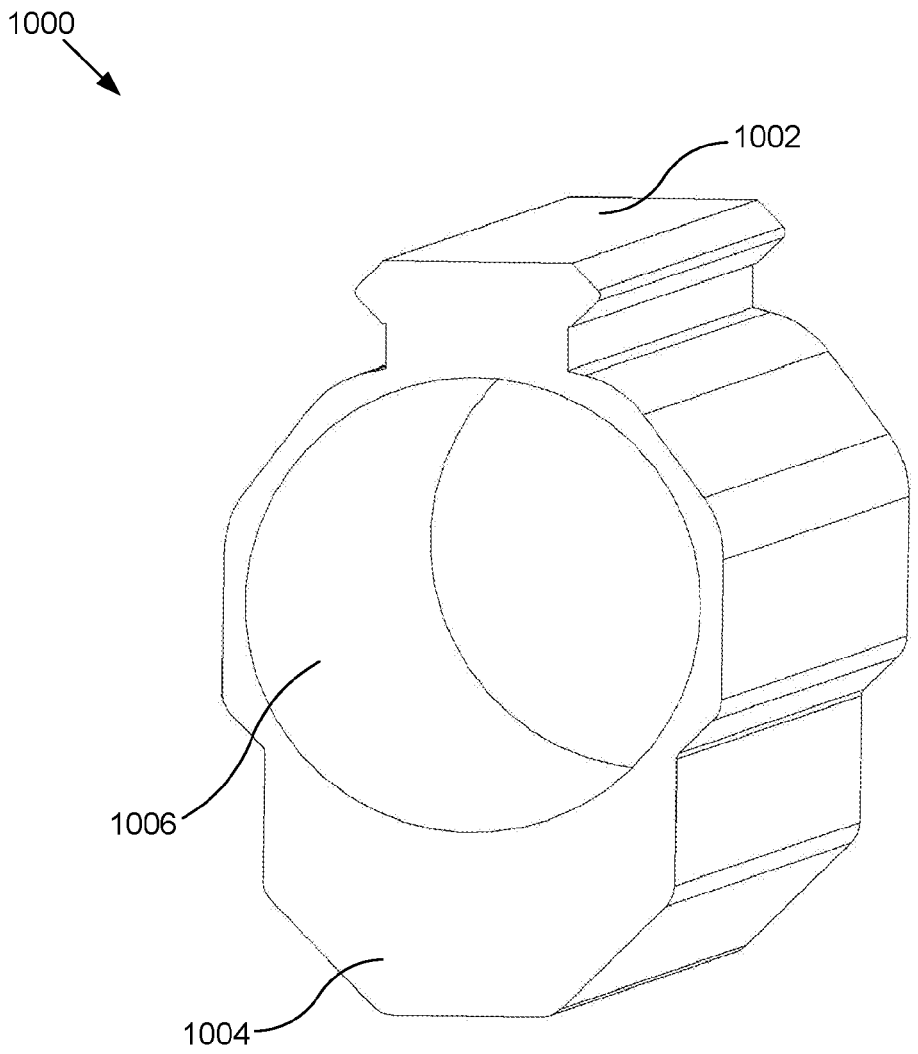
FIG. 10 is a perspective view diagram illustrating one embodiment of an extrusion in accordance with embodiments of the present disclosure.

FIG. 10 is a perspective view diagram illustrating one embodiment of a portion of an extrusion in accordance with embodiments of the present disclosure. The depicted embodiment illustrates an end of an extrusion following the extrusion process described above. The extrusion 1000 is formed in the general shape of the receiver 104. The rail for accessory attachment is formed out of the top portion 1002 ("top portion" referring only to the depicted orientation, and not intended to be limiting in any manner). The bottom portion of the receiver 104 may also be machined from a bottom portion 1004, with texturing and grooves for increased usability and for engaging the slide rails of the carriage assembly 500.

The longitudinal bore 1006 is also depicted. In one embodiment, the longitudinal bore 1006 is formed as part of the extrusion process. In an alternative embodiment, the bore 1006 is precision drilled after the extrusion 1000 is formed. Transverse (i.e., perpendicular to the bore) openings may be machined to form, for example, the firing chamber that houses the bolt and the barrel extension. Various other openings may also be formed to accommodate the components described above with reference to FIGS. 1-9.

Figure 11:
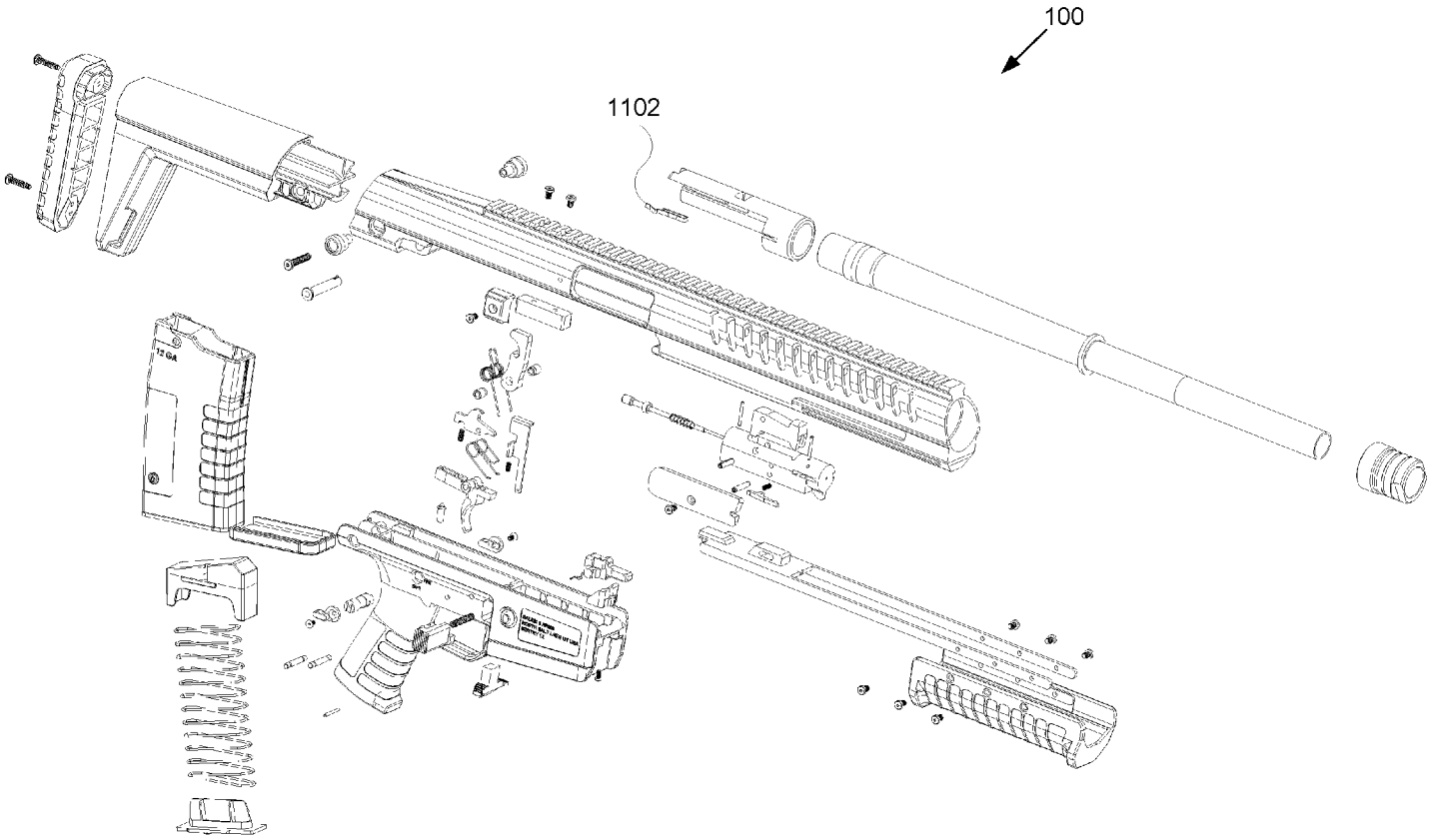
FIG. 11 is an exploded view diagram of substantially every component of the shotgun in accordance with embodiments of the present disclosure.

FIG. 11 is an exploded view diagram of substantially every component of the shotgun 100 in accordance with embodiments of the present disclosure. Also depicted is a replaceable ejection spring 1102 that is coupled to the barrel extension.

Aspects of the embodiments are described below with reference to a schematic flowchart diagrams that illustrates a method of manufacture. It will be understood that each block of the schematic flowchart diagram may represent one or more steps. Although various arrow types and line types may be employed in the flowchart, they are understood not to limit the scope of the corresponding embodiments. Indeed, some arrows or other connectors may be used to indicate only the logical flow of the depicted embodiment. For instance, an arrow may indicate a waiting or monitoring period of unspecified duration between enumerated steps of the depicted embodiment.

Figure 12:
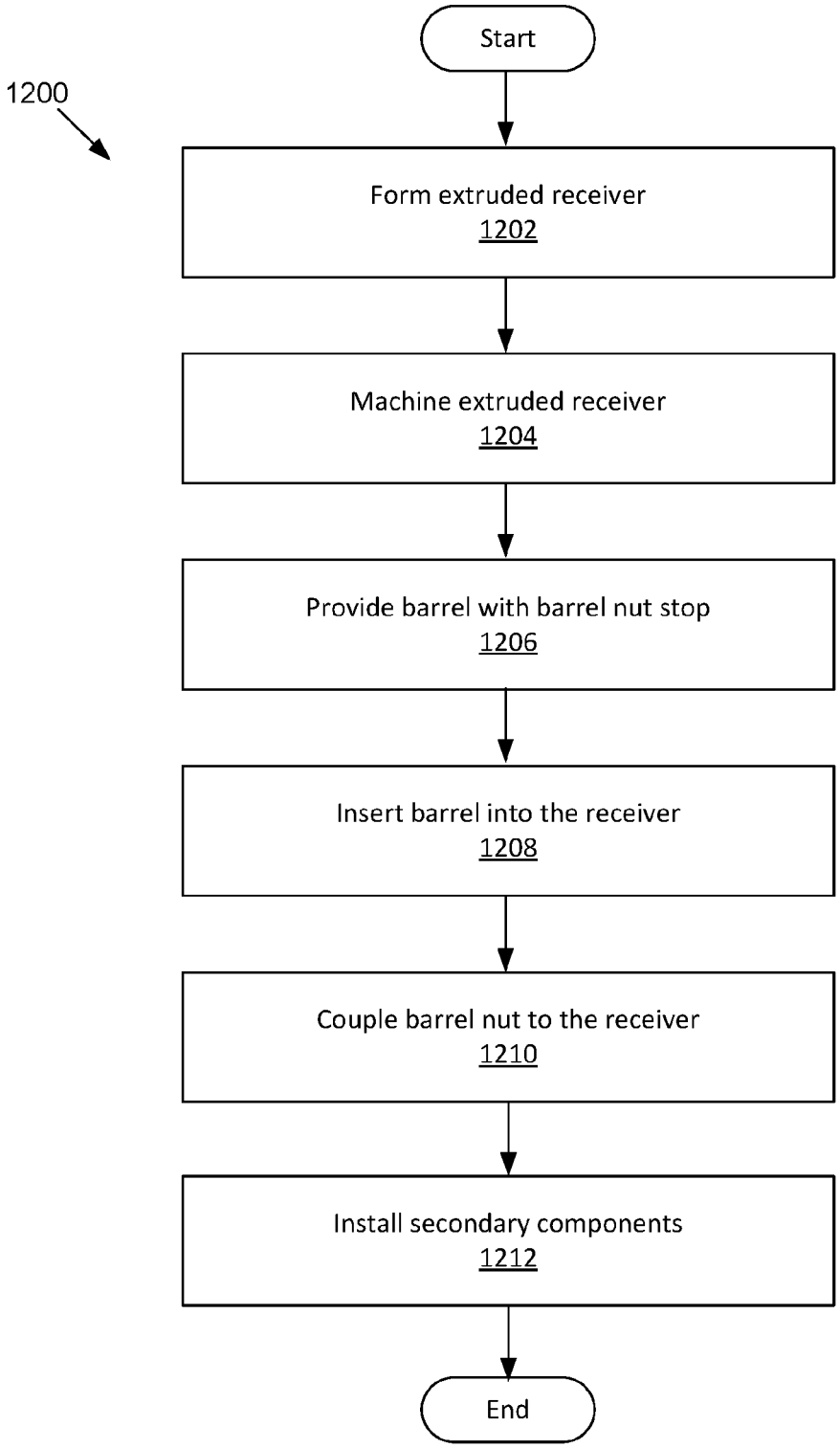
FIG. 12 is a schematic flow chart diagram illustrating one embodiment of a method for manufacturing a shotgun in accordance with embodiments of the present disclosure.

FIG. 12 is a schematic flow chart diagram illustrating one embodiment of a method 1200 for manufacturing a shotgun 100 in accordance with embodiments of the present disclosure. In one embodiment the method 1200 and an extruded receiver is formed 1202 by an extrusion process. As described above, the extruded receiver may be formed by one of a cold, hot, or medium extrusion process. The material used to form the extrusion may be an aluminum alloy, or another metal (i.e., titanium, etc.) or metal alloy.

At step 1204, the extruded receiver is machined. In one embodiment, machining the receiver includes, but is not limited to, forming a longitudinal bore, forming grooves, forming a rail for accessories, forming a transverse chamber opening, and forming various openings and features. At step 1206 a barrel is provided with a barrel nut stop. In one embodiment, the barrel is formed with an integral barrel nut stop. In alternative embodiments, the barrel nut stop may be permanently or removably attached to the barrel.

At step 1208, the barrel is inserted into the receiver, and the barrel nut is coupled to the receiver at step 1210. Finally, secondary components are installed 1212, including but not limited to, a grip assembly, the stock, the action, the trigger assembly, etc. Various assembly steps may have been omitted from the description of FIG. 12 for clarity. For example, attaching the barrel extension key to the receiver, anodizing the receiver, etc. Once the shotgun is assembled, the method 1200 ends.

Figure 13:
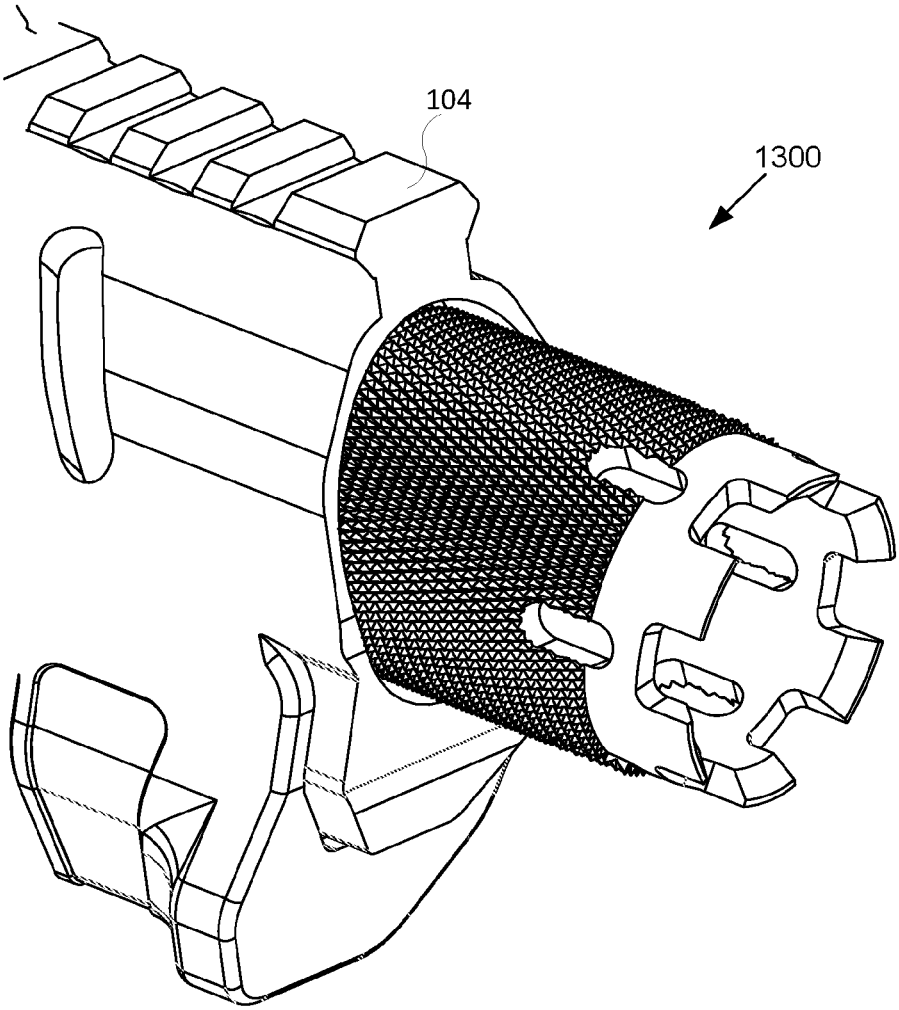
FIG. 13 is a perspective view diagram illustrating another embodiment of a barrel nut 1302 in accordance with embodiments of the present disclosure

FIG. 13 is a perspective view diagram illustrating another embodiment of a barrel nut 1302 in accordance with embodiments of the present disclosure. In the depicted embodiment, the barrel nut described above with reference to FIGS. 1-11 may be replaced with a breeching barrel nut 1300. In this embodiment, a shorter barrel may be inserted into the receiver 104 that does not extend past the barrel nut 1300. Accordingly, a breeching barrel nut 1300 may be used. The breeching barrel nut 1300, like the barrel nut described above, threads into the receiver and is configured to align one end of the barrel and secure the barrel inside the receiver (the barrel extension and barrel extension key align and index the other end of the barrel). In other embodiments, the breeching barrel nut 1300 may be replaced with a threaded suppressor, a threaded brake, a breeching brake, etc.

Reference throughout this specification to features, advantages, or similar language does not imply that all of the features and advantages that may be realized with the subject matter of the present disclosure should be or are in any single embodiment. Rather, language referring to the features and advantages is understood to mean that a specific feature, advantage, or characteristic described in connection with an embodiment is included in at least one embodiment of the present disclosure. Thus, discussion of the features and advantages, and similar language, throughout this specification may, but do not necessarily, refer to the same embodiment.

Furthermore, the described features, advantages, and characteristics of the subject matter of the present disclosure may be combined in any suitable manner in one or more embodiments. One skilled in the relevant art will recognize that the subject matter may be practiced without one or more of the specific features or advantages of a particular embodiment. In other instances, additional features and advantages may be recognized in certain embodiments that may not be present in all embodiments. These features and advantages will become more fully apparent from the following description and appended claims, or may be learned by the practice of the subject matter as set forth hereinafter.

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Additionally, instances in this specification where one element is "coupled" to another element can include direct and indirect coupling. Direct coupling can be defined as one element coupled to and in some contact with another element. Indirect coupling can be defined as coupling between two elements not in direct contact with each other, but having one or more additional elements between the coupled elements. Further, as used herein, securing one element to another element can include direct securing and indirect securing. Additionally, as used herein, "adjacent" does not necessarily denote contact. For example, one element can be adjacent another element without being in contact with that element.

Furthermore, the details, including the features, structures, or characteristics, of the subject matter described herein may be combined in any suitable manner in one or more embodiments. One skilled in the relevant art will recognize, however, that the subject matter may be practiced without one or more of the specific details, or with other methods, components, materials, and so forth. In other instances, well-known structures, materials, or operations are not shown or described in detail to avoid obscuring aspects of the disclosed subject matter.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A firearm comprising:

a barrel;

a barrel extension;

an extruded receiver having a longitudinal bore extending along the length of the extruded receiver, where the longitudinal bore forms a first opening in the extruded receiver, the first opening configured to receive the barrel and the barrel extension, and a second opening in the extruded receiver configured to receive a stock, where the barrel extension is partially cylindrical having a first opening configured to slidably couple to the barrel, a notch formed in a second opening, and a cartridge ejection window, and where the extruded receiver comprises a cartridge ejection opening formed in a side of the extruded receiver;

a barrel extension key coupled to an interior surface of the longitudinal bore, the barrel extension key configured to insert into the notch, and to index and position the barrel extension with reference to the extruded receiver to align the cartridge ejection window with the cartridge ejection opening; and a barrel nut configured to couple with the first opening of the extruded receiver and engage a barrel nut stop that extends annularly around the barrel to maintain the barrel and the barrel extension substantially inside of the longitudinal bore between the barrel extension key and the barrel nut.

2. The firearm of claim 1, further comprising machined features formed in an exterior surface of the extruded receiver.

3. The firearm of claim 2, where the machined features comprise a plurality of transverse grooves forming a rail for receiving firearm accessories.

4. The firearm of claim 2, where the machined features comprise a pair of longitudinal grooves disposed opposite each other on sides of the extruded receiver, and where the pair of longitudinal grooves are configured to slideably engage slide members of a carriage assembly.

5. The firearm of claim 4, where the carriage assembly further comprises a bolt assembly coupled to the carriage assembly, where the bolt assembly comprises a locking lug, and a firing pin.

6. The firearm of claim 4, where the carriage assembly further comprises a grip assembly having a profile selected to slideably engage a bottom surface of the extruded receiver, and where the grip assembly is coupled to each of the pair of slide members.

7. The firearm of claim 1, further comprising a magazine well opening formed in the extruded receiver and configured to receive a magazine, where the magazine, when coupled, extends outward in a substantially perpendicular direction from the longitudinal bore.

8. The firearm of claim 7, further comprising a shelf formed adjacent the magazine well opening and configured to engage and support a protrusion of a fire control group, such that the protrusion secures, together with a single pin fastener, the fire control group to the extruded receiver.

9. The firearm of claim 8, where the fire control group further comprises a pair of grooves configured to receive a pair of slide members of a carriage assembly.

10. The firearm of claim 1, further comprising a fastener opening passing transversely through the extruded receiver adjacent the second opening, the fastener opening configured to receive a fastener that couples a stock with the extruded receiver, where the stock has a portion that inserts into the second opening.

11. The firearm of claim 1, further comprising a threaded portion formed in the extruded receiver and positioned adjacent the first opening, the threaded portion configured to engage threads of the barrel nut.

12. The firearm of claim 11, where the barrel is configured with a length that, when inserted into the extruded receiver, does not extend outward past the barrel nut.

13. The firearm of claim 12, where the barrel nut comprises a door breech.

* * * * *